US005471866A

United States Patent [19]

Griffiths et al.

[11] Patent Number: 5,471,866

[45] Date of Patent: Dec. 5, 1995

[54] CIGARETTE TESTING DEVICE

[75] Inventors: Joseph A. Griffiths, Haslemere; Robert E. Williams, High Wycombe, both of England

[73] Assignee: Molins PLC, Milton Keynes, England

[21] Appl. No.: 182,698

[22] Filed: Jan. 13, 1994

[30] Foreign Application Priority Data

Jan. 16, 1993 [GB] United Kingdom ..... 9300798

[51] Int. Cl.[6] ..... G01M 3/04; G01N 15/08

[52] U.S. Cl. ..... 73/38; 73/41; 73/45.1

[58] Field of Search ..... 73/38, 41, 45, 73/45.1, 45.2

[56] References Cited

U.S. PATENT DOCUMENTS

| | | | |
|---|---|---|---|
| 3,769,832 | 11/1973 | Baier | 73/38 X |
| 4,181,007 | 1/1980 | Ariaska et al. | 73/38 X |
| 4,246,774 | 1/1981 | Flesselles et al. | 73/38 |
| 4,341,109 | 7/1982 | Evans, Jr. | 73/38 X |
| 4,400,972 | 8/1983 | Wiethaup | 73/38 |
| 4,627,448 | 12/1986 | Kamm et al. | 73/38 X |
| 4,630,466 | 12/1986 | Berlin | 73/38 |
| 5,369,986 | 12/1994 | Koch | 73/49.8 |

*Primary Examiner*—Hezron E. Williams
*Assistant Examiner*—J. David Wiggins
*Attorney, Agent, or Firm*—Antonelli, Terry, Stout & Kraus

[57] ABSTRACT

A flexible seal (2), particularly for use in pneumatic testing of cigarettes, includes a conical seat (6) attached to a tube (4) having a resilient collar (8). The collar permits longitudinal movement of the seat relative to the tube, thereby permitting an effective seal against the cigarette being tested, and contributes to extended life for the seal.

15 Claims, 1 Drawing Sheet

CIGARETTE TESTING DEVICE

Figure 1:
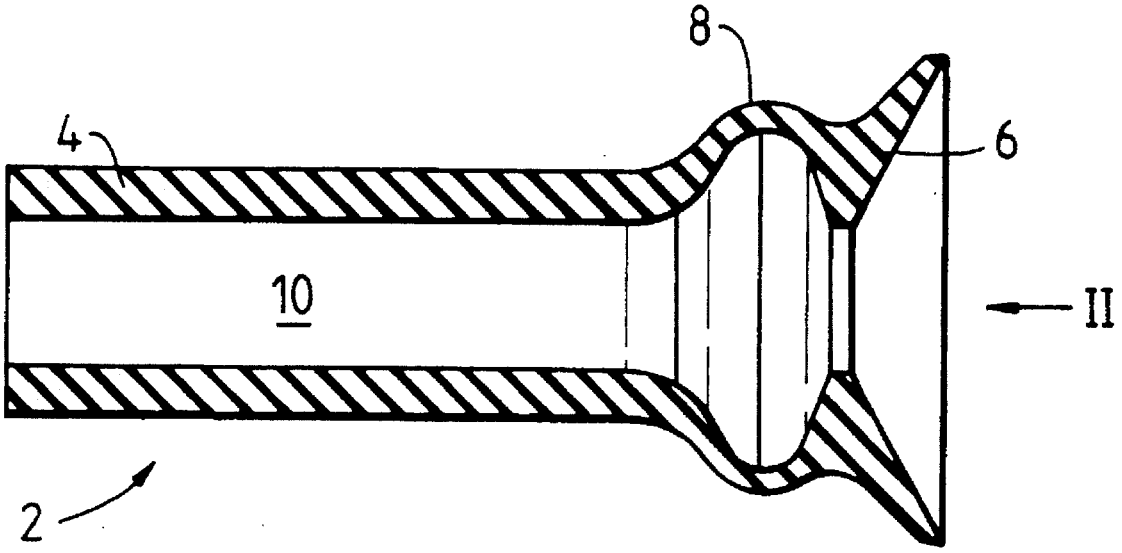

This invention relates to a testing device for cigarettes and similar rod-like articles.

It is known to test cigarettes by detecting an air flow and/or pressure through or in a cigarette using a flexible seal which resiliently engages an end of the cigarette at a test station. Known seals comprise a cylindrical part and a conical end portion made of a flexible elastomeric material. The end portion is so shaped as to engage all the way around the edge of an end of a cigarette (particularly the filter end of a filter cigarette) so as to form a close seal without damaging the cigarette. Usually the other end of the cigarette is engaged by a flexible push member which pushes the cigarette against the flexible seal. A typical testing device incorporating this type of arrangement is disclosed in British patent specification No. 2050804A, to which reference is directed for further details.

It will be appreciated that the seals are subjected to repeated flexing by contact with successive cigarettes and that this flexing occurs at a high rate in modern high speed filter cigarette assembling machinery. In one such version of this machinery, capable of processing cigarettes at a rate of 10,000 a minute, there are two rows of 24 seals: each seal therefore contacts and seals against cigarettes at a rate of more than three a second. Under such conditions of repeated flexing seals commonly fail, e.g. by splitting, in under 10 hours operation of the machine.

U.S. Pat. No. 3555883 discloses an arrangement in which the cigarette end is contacted by a rigid sealing element, this element being connected to an elastically-deformable tubular coupling element which allows the sealing face of the element to change its inclination to accommodate a cigarette presenting an inclined end face.

British patent specifications Nos. 1468927 and 2138266A disclose sealing means for filter cigarette ends comprising a tube of flexible material provided at one end with an annular sealing membrane which engages the cigarette end.

British patent specification No. 2183136A discloses a sealing means in the form of a cup-shaped member having an elastically-deformable annular portion which seals around the cylindrical surface of a cigarette adjacent its end face.

According to the present invention a sealing element, particularly in a device for pneumatically testing cigarettes or similar rod-like articles, comprises a seat capable of sealing against the end of a cigarette to be tested and a tube having a passage in pneumatic communication with the seat, wherein the seat and tube are connected by a resilient part adapted to permit longitudinal movement of the seat relative to the tube on engagement of a cigarette end with the seat. In a preferred embodiment the seat, tube and resilient part are resiliently formed from elastomeric material, e.g. silicone rubber. The tube is preferably cylindrical and the seat is preferably conical. In this case the resilient part may comprise a collar of greater diameter than the diameter of the tube, thus forming a convex ring between the seat and the tube. The curvature of the collar in a longitudinal direction relative to the element provides a region of lesser longitudinal stiffness than the remainder of the tube and hence a preferred position at which flexing in response to longitudinal pressures takes place. Moreover, such flexing provides cushioning for the seat and tends to prevent excessive distortion of the latter as it is pressed on to a cigarette end. More generally, the resilient part may comprise a collar having one or more curves or convolutions in a longitudinal direction, whereby the collar is adapted to flex longitudinally, i.e. in a direction parallel to a cigarette being tested. The longitudinal flexing need not be the same in all places around the tube, i.e. the seal may tilt so as to seal against an inclined cigarette end face.

By providing a region having additional resilience, and particularly by adapting its geometry to flex longitudinally, with the region displaced from the seat, an extended life for the seal may be obtained while maintaining an effective sealing action against the end face of a cigarette. Because of the provision of the resilient part it may be possible to make the seat itself longitudinally stiffer than would otherwise be the case, while still obtaining a satisfactory sealing action: this also may contribute to the extended life of the seal in use.

Figure 2:
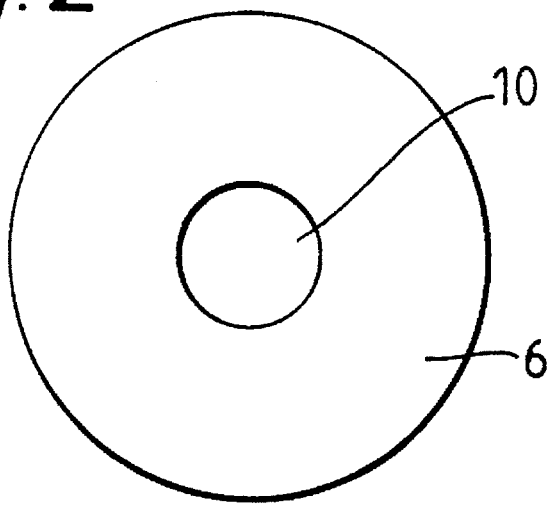

The invention will be further described, by way of example only, with reference to the accompanying drawings, in which FIG. 1 is a longitudinal section through a seal, and FIG. 2 is an end view in the direction of arrow II in FIG. 1.

The seal 2, which is capable of use in a pneumatic inspection device similar to that disclosed in said British patent specification No. 2050804A, comprises a cylindrical tube 4 and an annular, part-conical seat 6. Disposed between the tube 4 and seat 6 is an integral collar 8 having a convex outer periphery as viewed in FIG. 1. An air passage 10 extends longitudinally through the seal 2.

In use, when a cigarette is pressed against the seat 6, the collar 8 flexes, effectively increasing the curvature of its convex shape, thereby absorbing longitudinal movement in preference to distortion of either the tube 4 or seat 6. Once a cigarette is sealed against the seat 6 air flow and pressure sensing by way of the internal passage 10 is permitted.

Examples of seals made of silicone rubber, post cured for four hours at 200° C., can have extended life (e.g. up to 200 hours or more in said machinery) as compared with conventional seals.

We claim:

1. A sealing element for use in pneumatically testing cigarettes or similar rod-like articles, comprising a seat capable of sealing only against the end face of a cigarette to be tested, the end face being a surface which is transverse to the axis of the cigarette, and a tube having an unobstructed flow passage in communication with the seat, wherein the seat and tube are connected by a resilient part adapted to permit longitudinal movement of the seat relative to the tube on engagement of a cigarette end face with the seat.

2. A sealing element as claimed in claim 1, wherein said resilient part includes a portion having a curvature which is variable to permit said longitudinal movement.

3. A sealing element as claimed in claim 1, wherein the resilient part comprises an annular collar.

4. A sealing element as claimed in claim 3, wherein the collar comprises at least one convolution.

5. A sealing element as claimed in claim 4, wherein the seat is generally part-conical and the tube is generally cylindrical having an external diameter which is less than at least part of the collar.

6. A sealing element as claimed in claim 1, wherein the seat, tube and resilient part are formed from elastomeric material.

7. A sealing element for use in pneumatically testing cigarettes or similar rod-like articles, comprising a seat capable of sealing against the end face of a cigarette to be tested, and a tube having a passage in communication with the seat, wherein the seat and tube are connected by a resilient part adapted to permit longitudinal movement of the seat relative to the tube on engagement of a cigarette end with the seat, wherein the seat, tube and resilient part are integrally formed from elastomeric material.

8. A sealing element for use in pneumatically testing cigarettes or similar rod-like articles, comprising a seat having a part-conical surface for engaging the end face of a cigarette so as to effect a seal only with the end face of the cigarette for testing, the end face being a surface which is transverse to the axis of the cigarette; a tube having a passage in communication with said seat; and a resilient part, including a collar having at least one convolution immediately adjoining the seat and providing a coupling between said seat and said tube, for permitting longitudinal movement of the seat relative to the tube on engagement of a cigarette end with the seat, wherein the seat, tube and resilient part are integrally formed.

9. A sealing element as claimed in claim 8, wherein said collar is adapted to flex so as to allow said seat to become inclined relative to the axis of the tube, thereby to accommodate cigarettes with inclined faces.

10. A sealing element as claimed in claim 8, wherein the seat, tube and resilient part are formed from elastomeric material.

11. A sealing element for use in pneumatically testing cigarettes or similar rod-like articles, comprising annular seat means for sealing only against the end face of a cigarette to be tested, the end face being a surface which is transverse to the axis of the cigarette, a tubular member having an unobstructed axial flow passage, and resilient means connecting said seat means to said tubular member for permitting longitudinal movement of said seat means relative to the tube member on engagement of a cigarette end with the seat means.

12. A sealing element as claimed in claim 11, wherein said seat means includes an annular inclined surface for engagement with a circumferential portion of an end face of a cigarette.

13. A sealing element as claimed in claim 11, wherein said resilient means comprises a resilient annular part having a curvature which is variable to permit said longitudinal movement.

14. A sealing element as claimed in claim 11, wherein said resilient means includes an annular collar having at least one circumferential convolution.

15. A sealing element for use in pneumatically testing cigarettes or similar rod-like articles, comprising annular seat means for sealing against the end face of a cigarette to be tested, a tubular member having an axial passage, and resilient means connecting said seat means to said tubular member for permitting longitudinal movement of said seat means relative to the tube member on engagement of a cigarette end with the seat means, wherein said seat means, said resilient means and said tubular member are disposed in axial alignment and are integrally formed.

* * * * *